US005341873A

United States Patent [19]

Carter et al.

[11] Patent Number: 5,341,873

[45] Date of Patent: Aug. 30, 1994

[54] METHOD AND APPARATUS FOR DEVIATED DRILLING

[75] Inventors: Thurman B. Carter, Pearland; Mark W. Schnitker, Friendswood, both of Tex.

[73] Assignee: Weatherford U.S., Inc., Houston, Tex.

[21] Appl. No.: 945,669

[22] Filed: Sep. 16, 1992

[51] Int. Cl.[5] ..... E21B 23/00

[52] U.S. Cl. ..... 166/117.5; 166/117.6

[58] Field of Search ..... 166/117.5, 117.6, 120, 166/132, 134, 191

[56] References Cited

U.S. PATENT DOCUMENTS

| | | | |
|---|---|---|---|
| 1,816,856 | 8/1931 | Kinzbach et al. | 255/1 |
| 1,866,087 | 7/1932 | Crowell . | |
| 2,633,331 | 3/1953 | Hampton | 255/1.6 |
| 3,075,583 | 1/1963 | Nielsen | 166/117.5 |
| 3,096,824 | 7/1963 | Brown | 166/210 |
| 3,172,488 | 3/1965 | Roxstrom | 175/81 |
| 4,153,109 | 5/1979 | Szescila | 166/117.6 X |
| 4,285,399 | 8/1981 | Holland et al. | 166/117.6 X |
| 4,397,355 | 8/1983 | McLamore | 166/117.6 X |
| 4,665,995 | 5/1987 | Braitwaite et al. | 175/45 |
| 5,115,872 | 5/1992 | Brunet et al. | 175/61 |

FOREIGN PATENT DOCUMENTS

| | | |
|---|---|---|
| 0434924A1 | of 1989 | European Pat. Off. . |
| PCT/US93/-00684 | 1/1992 | PCT Int'l Appl. . |
| 727897 | of 1950 | United Kingdom . |

OTHER PUBLICATIONS

PCT/EP93/02504 Int'l Search Report.

"Kinzbach Tool Co. Inc. Catalog 1958-59, " Kinzbach Tool Company, Inc., 1958; see pp. 3-5 particularly.

"A-1 Bit & Tool Company 1990-91 General Catalog," A-Bit & Tool Company, pp. 8, 14, 1990.

"Dual horizontal extension drilled using retrievable whipstock," Cress et al. Worked Oil, Jun. 1993, five pages.

"Casing Whipstocks," Eastman Whipstock, Composite Catalog, p. 2226, 1976-77.

"Bowen Whipstocks," Bowen Oil tools, Composite Catalog 1962-63.

*Primary Examiner*—Thuy M. Bui

*Attorney, Agent, or Firm*—Guy McClung

[57] ABSTRACT

A whipstock assembly which includes a guide section and a setting section, wherein the setting section is configured to facilitate slight rotation of said setting section when the whipstock is set within a well, which rotation urges the guide section securely against the sidewall of the wellbore. Setting section includes a surface which will serve as a fulcrum, and a radially moveable element which serves to apply a force to one side of the whipstock, allowing the whipstock assembly to move as a lever, wherein the guide section is caused to meet the wellbore sidewall.

22 Claims, 7 Drawing Sheets

METHOD AND APPARATUS FOR DEVIATED DRILLING

BACKGROUND OF THE INVENTION

The present invention relates generally to methods and apparatus for deviated drilling of wells, such as oil and gas wells, and more specifically relates to improved whipstocks and methods of their use to initiate a deviated wellbore at a desired depth and in a desired direction relative to an existing wellbore.

Whipstocks have been utilized for many years to drill deviated boreholes "kicking-off" from an existing wellbore. These deviated boreholes may extend from a so-called "vertical" or so-called "horizontal" wellbore. As is well-known, virtually no borehole is truly "vertical" and therefore virtually all wellbores have a low side and a high side. Typically, whipstocks include a ramp inclined from one side of the wellbore to the other. This ramp is adapted to guide a mill toward the sidewall of the casing to enable a section of the casing and the surrounding formation to be removed to initiate the deviated borehole.

Conventional whipstocks have been subject to a significant limitation in that conventional whipstocks have typically required their orientation with the ramp extending along the low side of a borehole. This orientation has been necessary with conventional designs to assure that the ramp of the whipstock would not become displaced into the center of the borehole where it would both fail to serve the necessary guiding function and would also be subject to significant damage from attempts to operate the mill within the wellbore above the whipstock.

This need for orientation has several adverse consequences. First, the necessary orientation of conventional whipstocks on the low side of the wellbore causes the milling to be performed on the high side of the wellbore. In highly deviated wellbores, this results in the milling being done in opposition to the force of gravity. Additionally, it would only be a matter of circumstance for any given drilling operation if the optimal kick-off location for a deviated borehole was actually on the high side of the wellbore. Thus, the limitations of conventional whipstocks have often required either compromises in the orientation of the well or the use of expensive navigational drilling equipment to direct the deviated borehole to its desired end location, after kicking off on the high side of the borehole. As a further consequence, the orientation of whipstocks has required the use of surveying and orienting equipment to be certain that the whipstock was orientated with the ramp along the low side of the borehole, to avoid the problems identified above. Further, the required orientation of conventional whipstocks has required that the whipstocks be run into the wellbore on a work string which could be rotated to achieve the necessary orientation along the low side of the borehole. This requirement has effectively precluded the use of coil tubing to set whipstocks.

Another drawback with conventional retrievable whipstock mechanisms has been the difficulty of retrieving whipstocks from the well after use. Most conventional retrieval mechanisms have required the use of a "female" sleeve which would slip over at least a significant portion of the whipstock guide section to mechanically engage the guide section and to remove the whipstock from the well. Such sleeve type apparatus while effective, can be relatively expensive to construct, and relatively awkward to utilize.

Accordingly, the present invention provides a new whipstock and method of use, wherein the whipstock does not require orientation relative to the borehole, and therefore may be run into the borehole in any desired manner, including on coil tubing; but which may be oriented in any desired relation to the wellbore, without concern for orientation along the low side of the wellbore. The present invention further provides an improved whipstock and retrieval mechanism facilitating the removal of the retrievable whipstock from a wellbore to a relatively simple and inexpensive cooperative arrangement between the whipstock and a retrieval tool.

SUMMARY OF THE INVENTION

The present invention provides a whipstock assembly which includes a guide section and a setting section. These separate sections may either be separate assemblies which are coupled together, or may be formed as a single unit. In the preferred embodiment of whipstock assembly, the two sections will be formed independently and coupled together.

The setting section includes a housing assembly, a contact pad assembly extending from the housing assembly which will act as a fulcrum, and a radially moveable member, such as a conventional slip member, which is arranged on the housing longitudinally beneath the contact pad. The contact pad may either be coupled to the housing or may be an integral part of the housing. The guide section includes a longitudinally-extending tapered guide ramp inclined from one side of the assembly toward the dimetrically opposite side. The guide ramp will guide a starting mill to initiate a deviated borehole.

In operation, the setting of the slip will cause a slight inclination of the body of the whipstock setting section, which will in turn cause inclination of the guide section of the assembly, causing the guide section to be urged into engagement with the sidewall of the wellbore casing. This inclination of the guide section into engagement with the casing, regardless of the amount or direction of inclination of the wellbore, facilitates orientation of the whipstock in any desired position within the wellbore. In other embodiments in accordance with the present invention, radially moveable members such as additional slip assemblies may be utilized to establish a fulcrum around which the whipstock will rotate when the setting slip is actuated to secure the whipstock within the wellbore.

In another aspect of the invention, the invention provides a whipstock and a whipstock retrieval mechanism to provide enhanced retrievability of a whipstock from a wellbore. In one particularly preferred embodiment, this assembly includes a retrieval recess or aperture in the whipstock, preferably in the guide, or "ramp", portion of the whipstock. The recess or aperture will preferably extend for at least a sufficient distance to facilitate a secure mechanical engagement, and may extend all the way through the guide member. The retrieval mechanism comprises a rod adapted to be coupled to a work string or other appropriate mechanism, with the rod terminating in a retrieval hook sized and configured to engage the retrieval aperture in the guide member. In a particularly preferred embodiment of this assembly, wherein the guide member will include a tapered concave recess, the retrieval rod hook will serve to be essentially self-locating in said retrieval aperture over a significant range of lateral rotation.

BRIEF DESCRIPTION OF THE DRAWINGS

FIG. 3 depicts the guide section of the whipstock assembly of FIG. 1.

DETAILED DESCRIPTION OF A PREFERRED EMBODIMENT

Figure 1A:
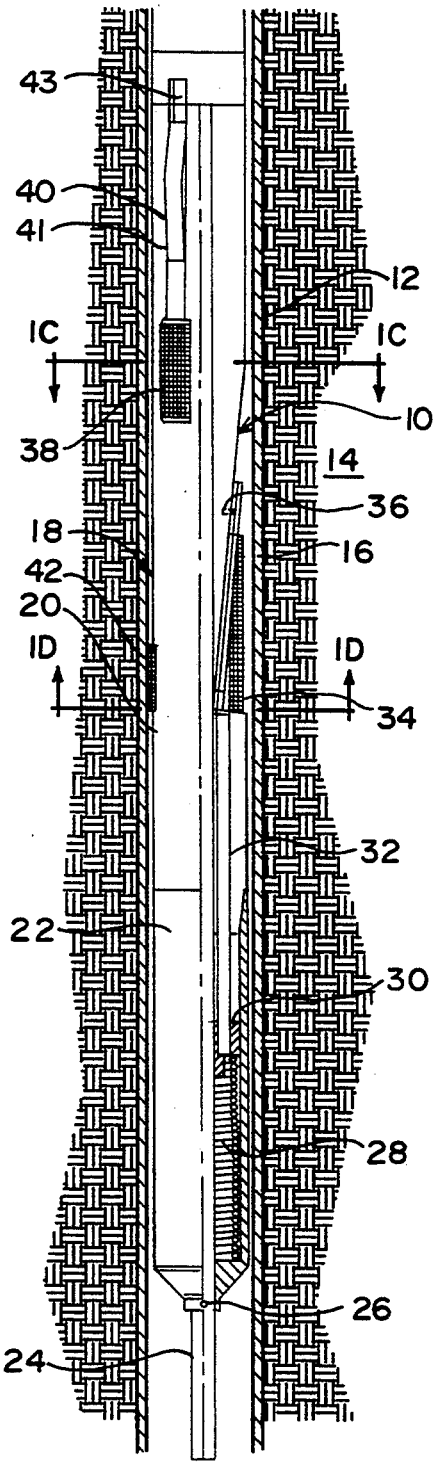
FIGS. 1A–D schematically depict an exemplary whipstock assembly in accordance with the present invention disposed in a typical operating environment, within a cased earth borehole, illustrated partially in vertical section, and depicted in horizontal section in FIGS. 1C–D.

Referring now to the drawings in more detail, and particularly to FIGS. 1A–D, therein is shown an exemplary whipstock assembly, indicated generally at 10, in accordance with the present invention. Whipstock assembly 10 is depicted in an exemplary operating environment in a borehole 12 penetrating an earth formation 14. Borehole 12 is lined with casing 16. In a manner which will be familiar to those skilled in the art, casing 16 will be secured within borehole 12 by an annulus of cement (not illustrated).

Whipstock assembly 10 includes a setting section, indicated generally at 18, and a guide section 19. Setting section 18 includes a housing assembly 20, which is coupled at a lower extent to an actuation housing 22. In the depicted preferred embodiment, whipstock assembly 10 is a "bottom trip whipstock" which is actuated by the setting down of weight on an actuation rod 24 which telescopically extends from the bottom of actuation housing 22. An actuation spring 28 is arranged to apply an upward force against an actuation piston 30 which is longitudinally slidable within actuation housing 22. Actuation rod 24 will be initially secured in a desired relation relative to actuation housing by a selectively releasable mechanism, such as shear pin 26. Shear pin 26 is established to shear at a desired force to withstand the force supplied by actuation spring 28 plus the desired set down weight to set whipstock 10.

Actuation piston 30 is operatively coupled to a setting rod 32, which is adapted to apply force to a setting slip 34. Setting slip 34 is slidably retained relative to housing 20 in a conventional manner. Setting slip 34 is intially retained in a retracted, unactuated, position through use of a releasable mechanism, such as a shear pin 36. In one preferred embodiment, actuation spring 28 is configured to exert a preload of approximately 600 pounds on actuation piston 30. Preferably, whipstock 10 will be configured such that when setting slip 34 engages the casing sidewall, actuation spring will still apply approximately 400 pounds of force on actuation piston 30.

Housing 20 also has a pair of fulcrum contact pads 38 extending therefrom, at a position longitudinally uphole relative to the position of slip 34. Fulcrum contact pads each preferably include toothed well engaging sections configured to securely "bite" into the casing sidewall to achieve secure engagement therewith. Fulcrum contact pads 38 may be arranged to extend from the tool for a specific desired distance. Fulcrum contact pads 38 are preferably arranged in a common horizontal plane; and on either side of, and evenly spaced relative to, a diametrical plane 39 through housing 20 which intersects the centerline 41 of setting slip 34. Accordingly, fulcrum contact pads 38 cooperatively establish a fulcrum, and therefore a rotational axis 45, extending between the two pads, around which housing 20 may rotate when slip 34 is set. Whipstock assembly 10 also preferably includes a deflection spring 40 adapted to prevent fulcrum contact pads 38 from dragging on the interior sidewalls of the casing as whipstock assembly 10 is lowered in the casing to a desired depth. Deflection springs 40 are of a conventional design, such as a bow spring type, with a first end 41 secured in a recess 43 within the housing, and a second end slidable within the recess 43. Deflection springs 40 may be placed either uphole or downhole relative to a particular fulcrum contact pad 38.

Whipstock assembly 10 also includes a centralizing pad 42 located generally diametrically across housing 20 from slip 34. Centralizing pad 42 is utilized to generally centralize whipstock assembly 10 within casing 16 so as to minimize the longitudinal movement of setting slip 34 necessary to achieve engagement with the interior of casing 16. Minimizing this longitudinal movement facilitates the maintaining of an optimal amount of spring force from actuation spring 28 on slip 34. In one exemplary embodiment, where whipstock body 20 has a 6.25 inch nominal outside diameter, for use within casing having a nominal 6.875 inch inside diameter, fulcrum contact pads 38 would each preferably extend approximately 0.375 inch beyond the outer diameter of housing 20. In this same exemplary embodiment, centralizing pad 42 will preferably extend approximately 0.312 inch beyond the outer diameter of housing 20.

Figure 1B:
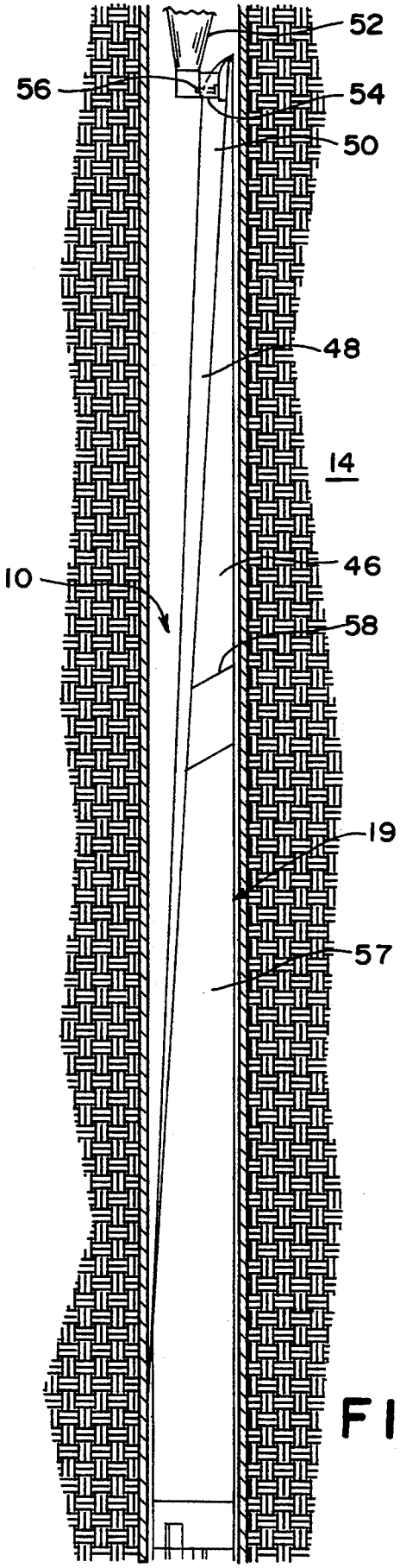
Figure 1D:
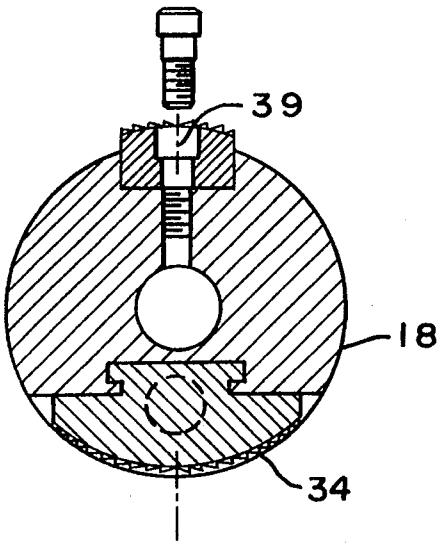
Figure 2A:
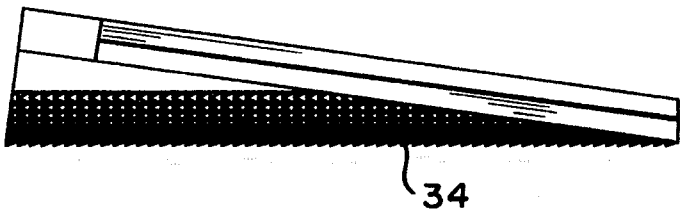
FIGS. 2A–B depict the slip of the whipstock assembly of FIG. 1, illustrated from a side view in FIG. 2A, and from a bottom end view in FIG. 2B.
Figure 1C:
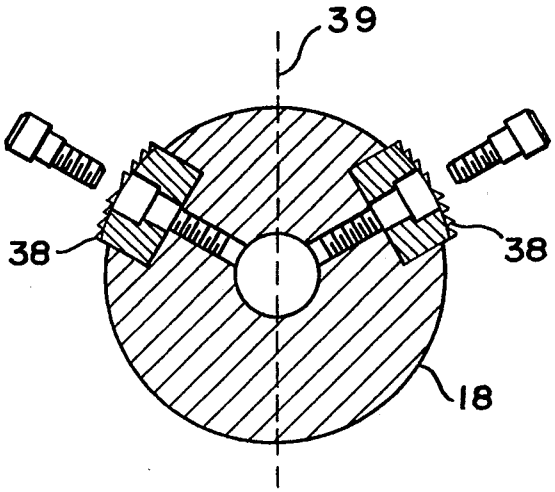
Figure 2B:
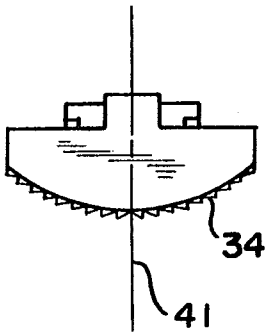

Coupled to setting section 18 is guide section 19. Unlike conventional whipstocks, guide section 19 is preferably not pivotally coupled, but is generally rigidly coupled, to setting section 18, such as by welding. As noted previously, guide section 19 may also be constructed as an integral portion of setting section housing assembly 20. Guide section 19, includes an elongate extension 46 which includes a support surface 57, which is a portion of generally cylindrical exterior, and which includes a guide surface having a tapered concave groove 48 forming a guide ramp. As can be seen in FIG. 1B, tapered concave groove 48 lies on the radially inwardly extending portion proximate the uppermost extent 50 of extension 46. As is well-known in the art, tapered concave groove 48 is conformed to guide a starting mill 52 toward an opposing side of the casing as the starting mill 52 is advanced longitudinally along ramp 48. Guide section 19 is coupled to setting section 18 with a ramp axis (55 in FIG. 6A) and support surface 57 longitudinally aligned with the centerline of setting slip 34.

In a conventional manner, whipstock assembly 10 will be run into the well on the end of a work string which includes a starting mill 52, which is coupled to whipstock assembly 10 through a coupling 54 and a shearable member 56, such as a shearable bolt.

In this particularly preferred embodiment, whipstock 10 is designed to be a retrievable whipstock and includes a retrieval slot 58 intermediate its length. In one exemplary embodiment, retrieval slot 58 is preferably approximately 8 inches in longitudinal dimension and is defined at a longitudinally uphold end by a downwardly-facing engagement surface 61. Engagement surface 61 is preferably inclined at an angle of approximately 60 degrees relative to the nominal longitudinal axis 57 of whipstock assembly 10. The use of retrieval slot 58 will be described in more detail in reference to FIGS. 4, 5A–C and 6A–D.

Figure 3A:
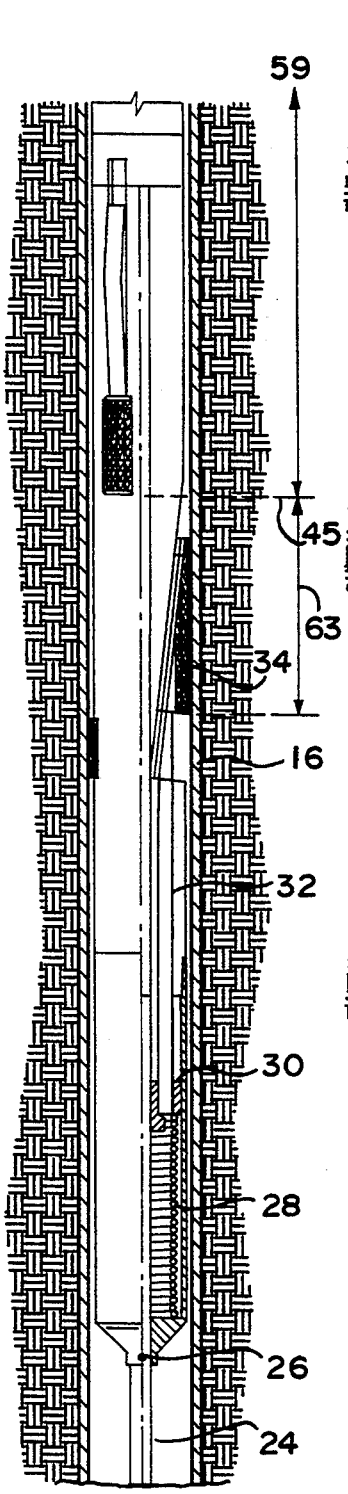
FIGS. 3A–B depict the whipstock assembly of FIG. 1 in an actuated position within a wellbore.
Figure 3B:
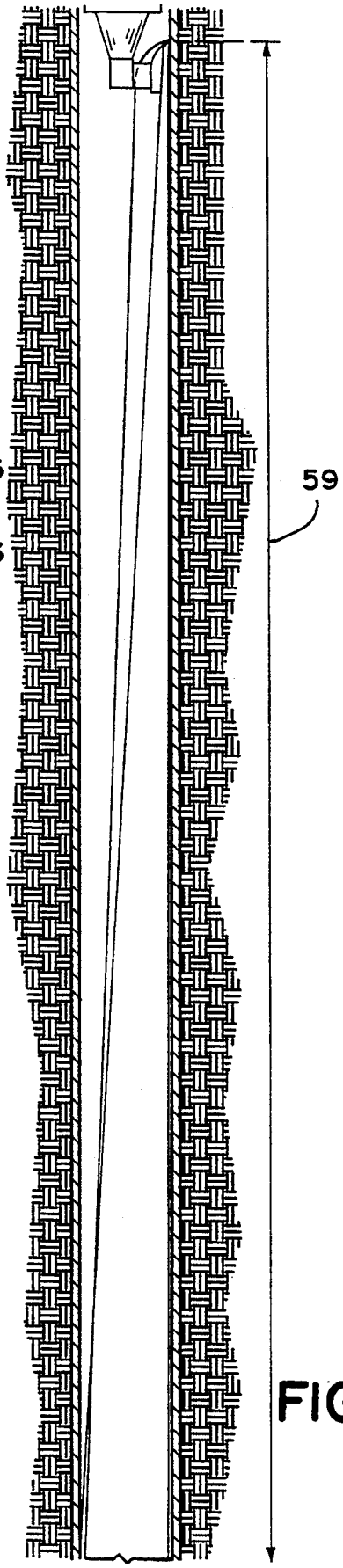
Figure 4:
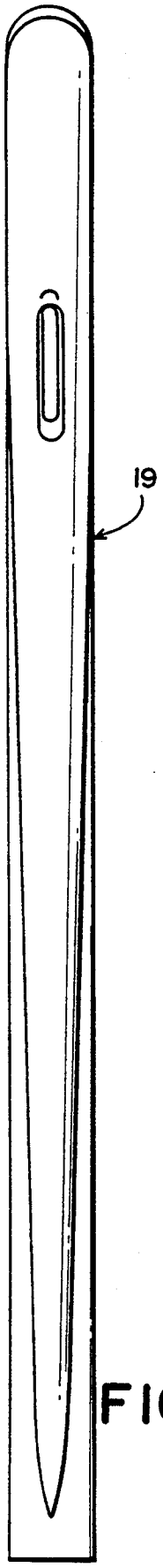
FIG. 4 depicts the guide section of the whipstock of FIG. 1 from a front view, rotated 90 degrees from that depicted in FIG. 1.
Figure 5B:
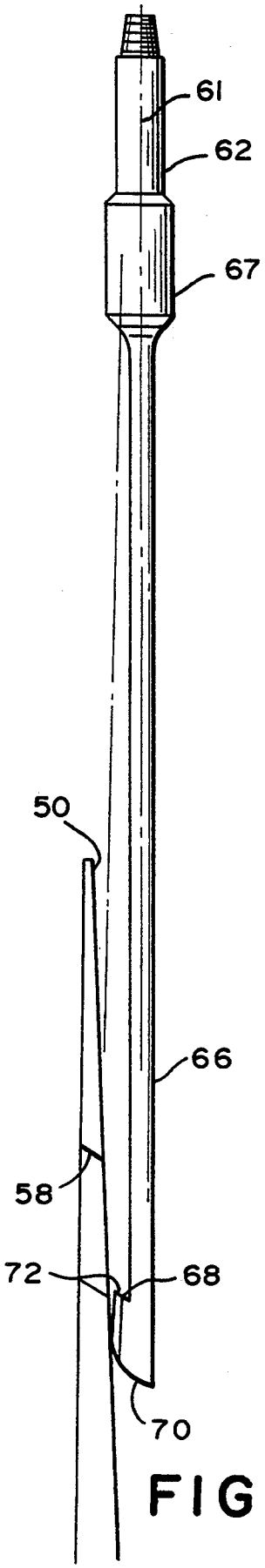
FIGS. 5A–C depict, in FIG. 5A, a retrieval rod of a whipstock assembly and retrieval mechanism in accordance with the present invention; and in FIGS. 5B–C, the operative engagement between the retrieval rod and a whipstock guide member, also in accordance with the present invention.
Figure 5C:
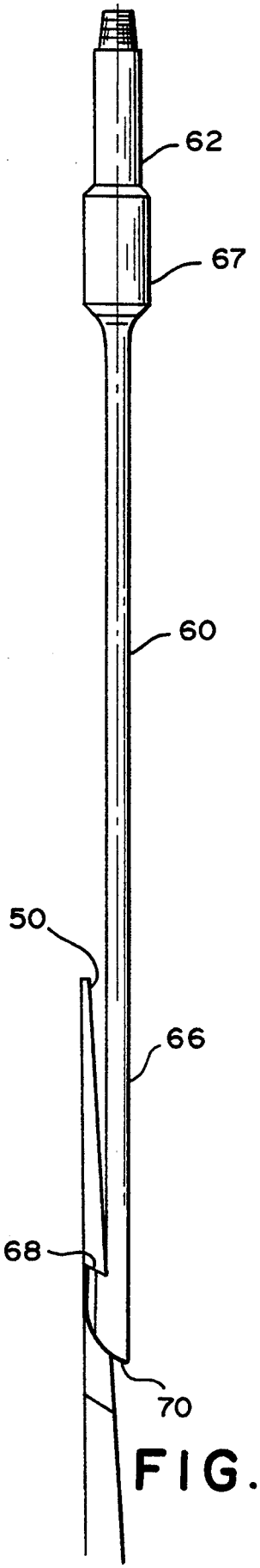
Figure 5A:
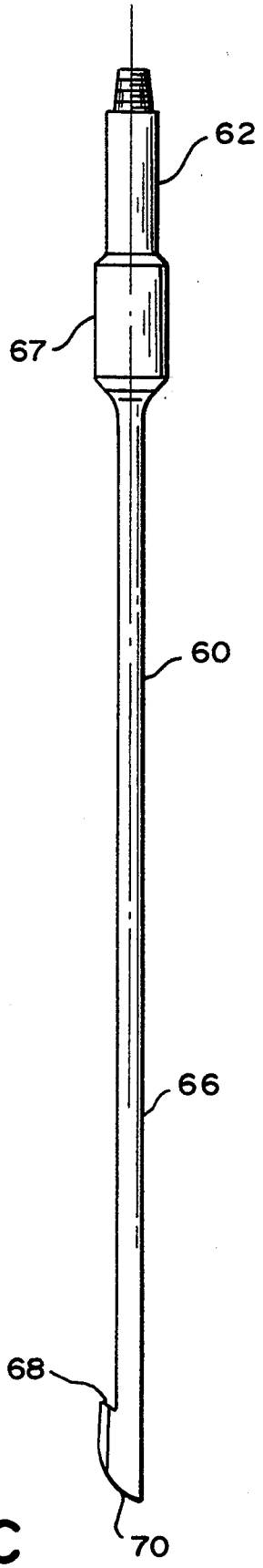

Referring now to FIGS. 3A–B, therein is shown whipstock assembly 10 after setting in the well. In a conventional manner, weight has been set down on whipstock 10 and applied through actuation rod 24 to shear shear pin 26. The shearing of shear pin 26 frees actuation piston 30 to move upwardly under the influence of actuation spring 28. This upward movement causes setting rod 32 to push upon slip 34, causing slip 34 to securely engage the interior sidewall of casing 16. At this time, further weight applied to whipstock assembly 10 through starting mill 52 and coupling 54 will result in slip 34 further engaging casing 16. The force applied to slip 34 will also cause whipstock housing 20 and actuation housing 22 to pivot relative to pivot block 38. This pivoting relative to pivot block 38 causes support surface 57 of extension 46 to be securely forced against the sidewall of casing 16. Because increasing the force applied to engage slip 34 also increases the leverage forcing extension 46 against the sidewall of casing 16, whipstock assembly 10 may be located with extension support surface 57 along any surface (low side, high side, etc.) of the casing sidewall. Accordingly, the pivoting action of whipstock assembly 10 avoids limitation of the prior art requiring the setting a whipstock with the guide section on the low side of the wellbore.

The configuration of whipstock assembly 10 is such that the force applied to fully set slip 34 of the whipstock will be multiplied to exert the described leverage on elongate extension 46. For example, where the distance 59 between upper end 50 of extension 46 to the axis established by fulcrum contact pads 38 is 176 inches; and the approximate distance 63 between the axis 45 and the bottom 47 of slip 34 when engaged is approximately 24 inches; and wherein a weight of 15,000 thousand pounds is set down on the top of whipstock assembly 10, upper end 50 of support surface 57 elongate extension 46 will be urged forward the casing sidewall with approximately 20,000 pounds of force.

Referring now to FIGS. 4, 5A–C and 6A–D, thein is depicted a retrieval assembly for use with a whipstock, such as whipstock assembly 10. Retrievable assembly includes a catch rod, indicated generally at 60. Catch rod includes an upset 62 and associated threaded pin 64 to facilitate coupling to a work string in a conventional manner. Catch rod 60 further includes a shaft 66, of a relatively reduced diameter and a relatively radially enlarged centralizing portion 67. Shaft 66 terminates in an upwardly extending hook 68. In one preferred embodiment, shaft will be approximately two inches in diameter, and hook 68 will be approximately four inches long and will extend approximately two inches from shaft 66. Preferably, the lower surface 70 of hook 68 will be beveled to allow hook 68 to ride over the objects which may be encountered in the well, including the upper end 50 of ramp 46. An upper engaging surface of 72 of hook 68 will preferably be inclined at an angle of approximately 60 degrees relative to the longitudinal axis 61 of shaft 60.

As can be seen in FIG. 5, the cooperative structure of catch rod 60 and retrieval aperture 58 facilitate hook 68 engaging retrieval aperture 58 whereby an upward pull may be applied, through extension 46, to housing assembly 20 of whipstock assembly 10 to cause upward movement of housing assembly 20 relative to slip 34, thereby releasing slip 34, and allowing whipstock assembly 10 to be removed from the wellbore.

Figures 6A, 6B, 6C, 6D:
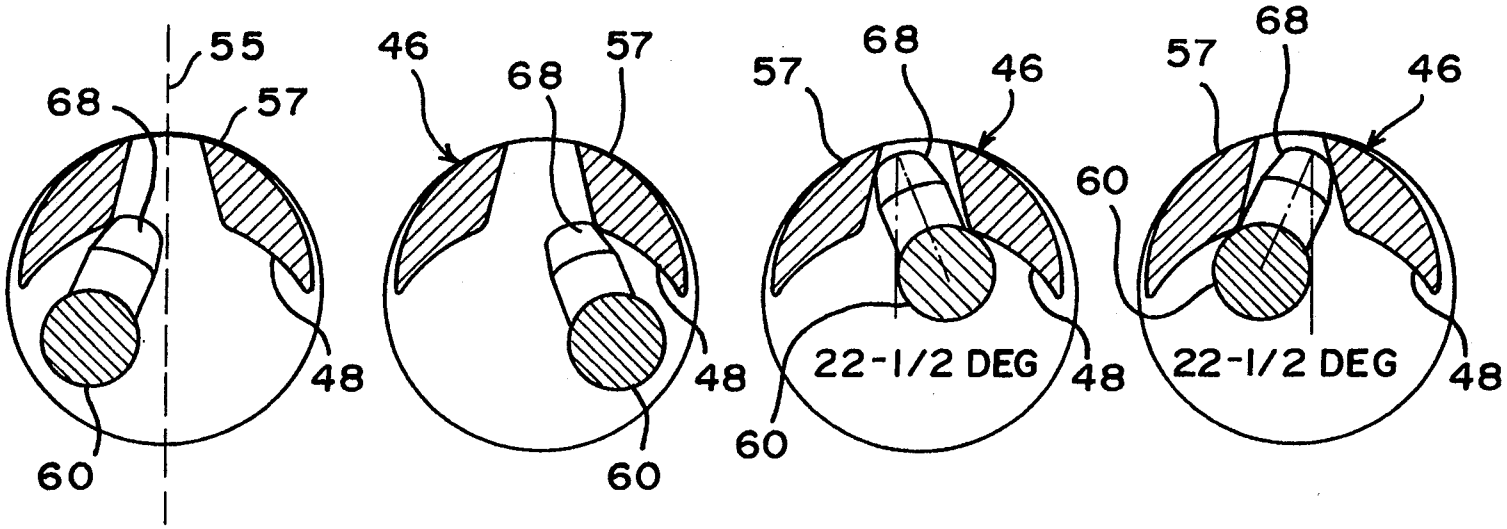
FIGS. 6A–D schematically depict the engagement of a retrieval rod and guide member of FIG. 5 over a range of relative rotation between the components.

FIG. 3 depicts the cooperation between the contour of catch portion 68 and tapered concave groove 48 in extension 46 which causes hook 68 to be essentially self-locating within retrieval aperture 58. As can be seen in FIGS. 6C and 6D, the assembly facilitates engagement between hook 68 and slot 58 over a range of approximately forty-five degrees. Accordingly, if attempts to manipulate catch rod 60 to engage whipstock 10 do not result in engagement, the work string may be incrementally rotated in approximately forty-five degree increments until engagement is achieved.

The structure and operation of an exemplary whipstock 10 in accordance with the invention having been described, alternative embodiments of whipstock assemblies are described in reference to FIGS. 7–12.

The general principle operation of whipstock assembly 10 having been described, the basic theory of operation of the embodiments of FIGS. 7–12 will not be repeated. The following discussion will focus upon the primary differences in operation of the described alternative embodiments with the expectation that the basic principle of operation may be understood in reference to the description of whipstock assembly 10 of FIGS. 1–6. Similarly, as a guide section 19, as described in reference to FIGS. 1–4, may be utilized with the setting section assemblies of FIGS. 5–8, it should be understood that each figure is directed primarily to the setting section of an alternative embodiment of a whipstock assembly. In the case of each of the embodiments of FIGS. 7–11, the guide section would be attached to the setting section in the same relation to the slip (or in the case of a two-slip embodiment to the lower slip), as previously described relative to the embodiment of FIGS. 1–4. Specifically, the support surface will be generally aligned with the centerlines of the slip(s). Elements which are essentially identical to elements discussed in relation to whipstock assembly 10 are numbered similarly.

Figure 7:
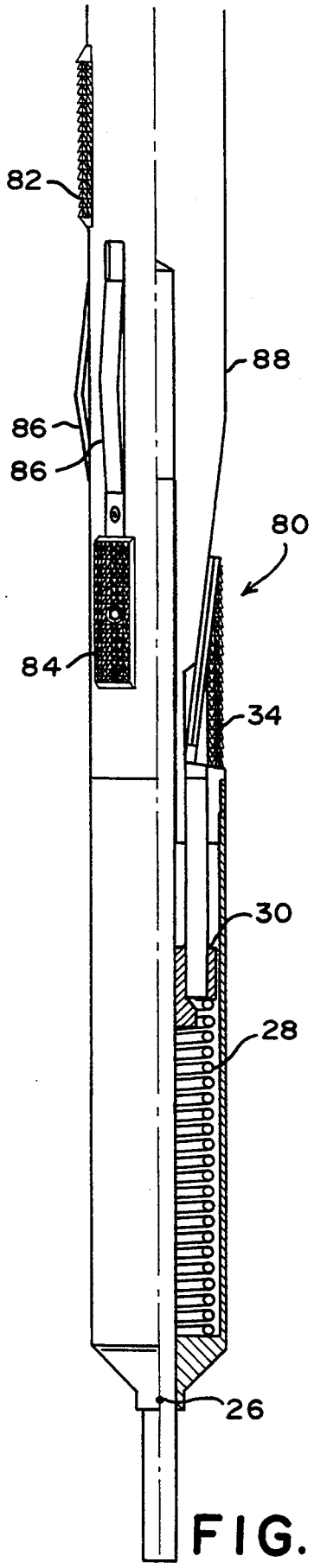
FIG. 7 schematically depicts an alternative embodiment of whipstock setting section assembly in accordance with the present invention, illustrated partially in vertical section.

Referring now to FIG. 7, therein is depicted an alternative embodiment of a whipstock setting assembly, indicated generally at 80, in accordance with the present invention. Whipstock setting section 80 differs from setting section 18 of whipstock assembly 10 primarily in that setting section 80 includes a single fulcrum pivot pad 82, and a pair of centralizing contact pads 84. Additionally, setting section 80 provides a deflection spring 86 for each centralizing contact pad 84 and for fulcrum pivot pad 82.

The embodiment of setting section 80 has the advantage of providing optimal centralizing of body 88 of setting section 80 within a wellbore (through the use of the two contact pads 84), thereby minimizing the radially outward movement (and therefore also the longitudinal movement) of slip 34 required to achieve a firm placement of setting section 80 within a wellbore. This has the advantage of minimizing the allowed travel of actuation piston 30, thereby maintaining relatively maximal loading on slip 34 from actuation spring 28. Because setting section 80 utilizes only a single fulcrum pivot pad, an axis of rotation will be established around the location at which fulcrum pivot pad 82 engages the sidewall of the well casing.

In setting section 80, centralizing contact pads 84 will preferably be placed generally horizontally across from slip 34, and generally symmetrically placed relative to a diametrical plane extending through the longitudinal centerline of slip 34. Fulcrum pivot pad 82 will preferably be placed generally aligned along such a plane.

Figure 8:
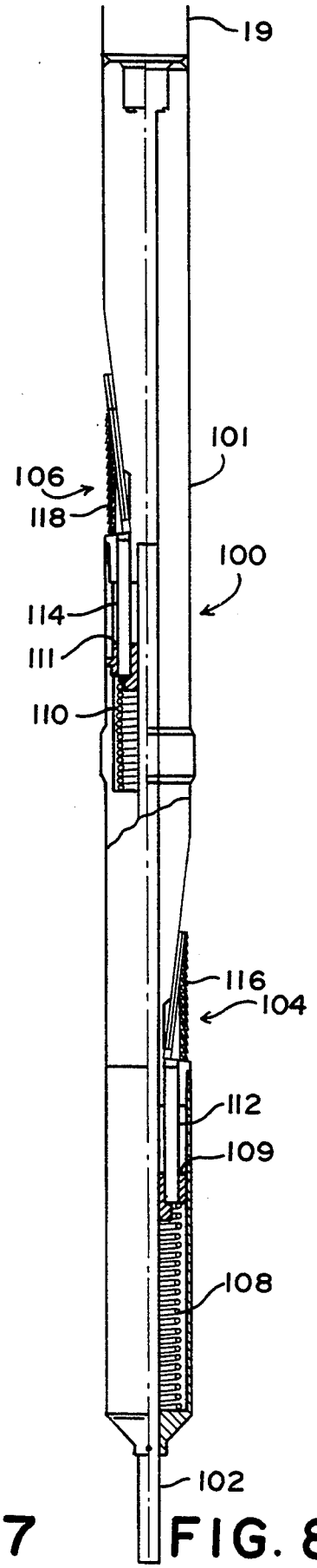
FIG. 8 schematically depicts an alternative embodiment of whipstock setting section assembly in accordance with the present invention, illustrated partially in vertical section.

Referring now to FIG. 8, therein is depicted a whipstock setting section assembly 100 which includes a dual slip arrangement. Setting section assembly 100 includes an actuation shaft 102 which is operatively coupled to a lower slip assembly, indicated generally at 104, and an upper slip assembly, indicated generally at 106. Upper and lower slip assemblies each include an actuation spring, 108 and 110, respectively; a moveable piston 109 and 111, respectively; a setting shaft 112 and 114, respectively; and a slip 116 and 118, respectively. Slips 116 and 118 are preferably placed on diametrically opposed sides of housing 101, with slip 116 serving as a fulcrum. Upon movement of setting rod 102, slip setting shafts 112 and 114 will be allowed to move upwardly to set slips 116 and 118. Preferably, lower slip 116 will set first, followed by upper slip 118. Setting section assembly 100 may be useful in close diameter holes, where it would be underirable to have contact pads (as discussed relative to whipstock assembly 10) extending from the body of the assembly.

Figure 9:
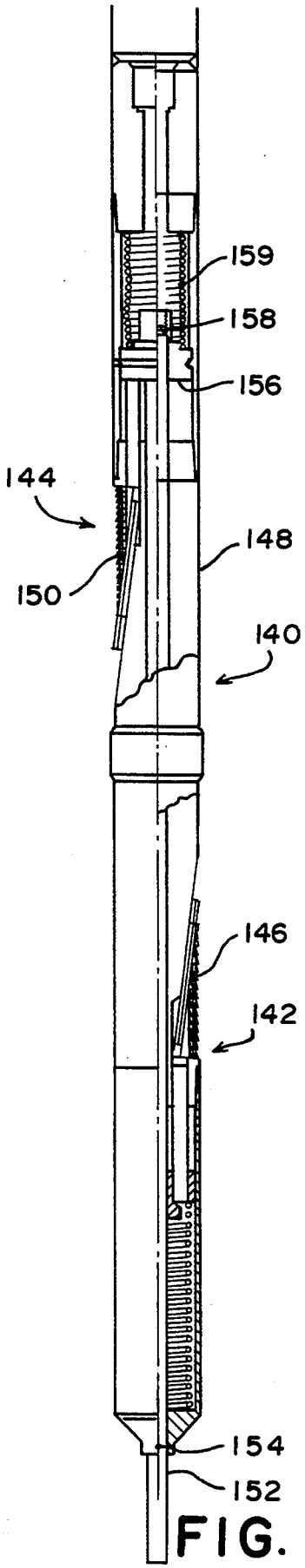
FIG. 9 schematically depicts an alternative embodiment of whipstock setting section assembly in accordance with the present invention, illustrated partially in vertical section.

Referring now to FIG. 9, therein is depicted a non-retrievable setting section assembly 140. Setting section assembly 140, once again includes a lower slip assembly, indicated generally at 142, and an upper slip assembly, indicated generally at 144. Setting section assembly 140 includes an actuation rod 152 which is restrained from movement relative to body 148 by a shear pin 154. Upper actuation piston 156 is restrained from movement relative to actuation rod 152 by a shear pin 158. Actuation piston 156 is restrained from relative upward movement relative to body 148 by upper slip assembly 144 actuation spring 159. Accordingly, movement of actuation rod 152 relative to body 148 shears shear pins 154 and 156 and facilitates the setting of upper and lower slip assemblies 144, 146.

As can seen in FIG. 9, slip 146 of lower slip assembly 142 will be urged into engagement with the casing upon generally downward movement of housing 148 of assembly 140 (as with the slips of previously discussed embodiments). However, upper slip 150 of upper slip assembly 144 will be urged into engagement with the casing upon relatively upward movement of body 148 of assembly 140. Thus, once slips 146 and 150 are released and urged into engagement with the casing sidewalls, longitudinal movement of whipstock assembly 140 in either direction will result in further setting slips 146 and 150, and a more secure immobilizing of assembly 140.

Figure 10:
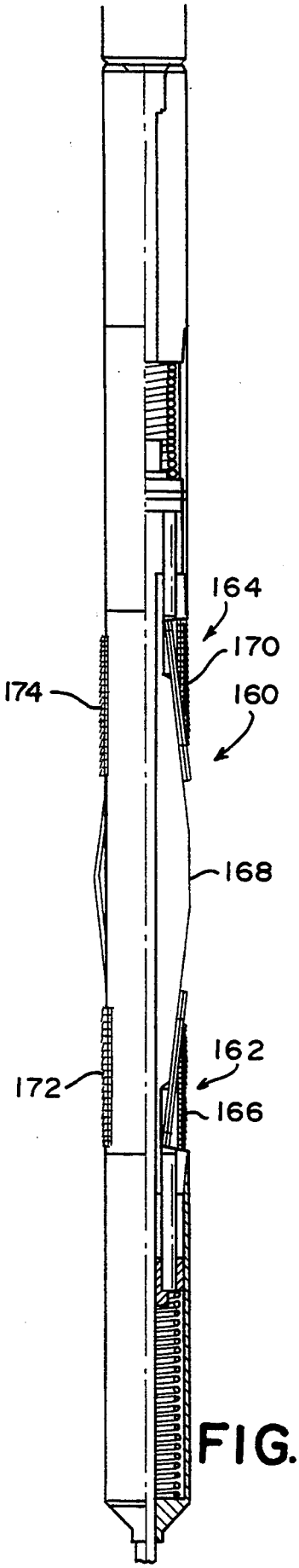
FIG. 10 schematically depicts an alternative embodiment of whipstock setting section assembly in accordance with the present invention, illustrated partially in vertical section.

Referring now to FIG. 10, therein is depicted another non-retrievable setting section assembly 160. Setting section assembly 160, also includes a lower slip assembly, indicated generally at 162, and an upper slip assembly, indicated generally at 164. Lower slip assembly 162 includes a slip 166 which will engage the casing upon relative upward movement of slip 166 relative to housing 168. Slip 170 of upper slip assembly 164 will be urged into engagement with the casing upon relative upward movement of body 168 relative to upper slip 170. Slips 166 and 170 are preferably generally longitudinally aligned with one another along one side of housing 168. In the depicted embodiment, generally diametrically opposed from each slip 166, 170, is a contact pad 172, 174, respectively. In one preferred embodiment, upper contact pad 172 will extend relative to the nominal diameter of housing 168 by a greater distance than that which lower contact pad 174 extends relative to housing 168. In one exemplary embodiment, upper contact pad 172 will extend approximately 0.125 inch relative to housing 168, while lower contact pad 174 will extend approximately 0.0625 inch relative to housing 168. In such an embodiment, lower contact pad 172 will serve primarily as a centralizing pad, while upper contact pad 174 will serve substantially as a fulcrum.

Figure 11:
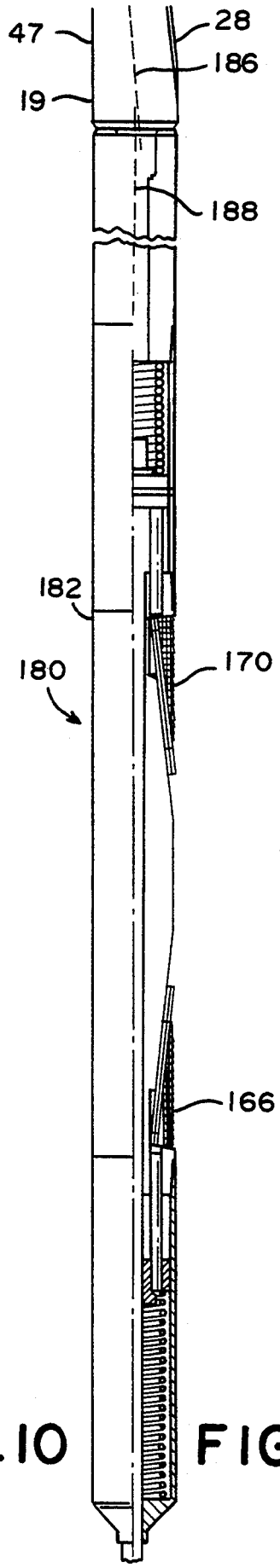
FIG. 11 schematically depicts an alternative embodiment of whipstock setting section assembly in accordance with the present invention, illustrated partially in vertical section.

Referring now to FIG. 11, therein is depicted another alternative embodiment of a whipstock setting section, indicated generally at 180, in accordance with the present invention. Setting section 180 is essentially identical to the embodiment of FIG. 10, with the exception that setting tool assembly 180 does not include any contact pads. Additionally, setting section 180 is adapted to be coupled to a guide section 19 with the support surface 47 of the guide section longitudinally aligned with the side of setting section 182 generally diametrically opposite the centerline of each slip. This is directly reversed relative to the preferred arrangement of guide section 19 described relative to previously discussed embodiments.

In operation, actuation of slips 166 and 170 will urge both setting section 182 and guide section 19 adjacent the casing sidewall. The arrangement will therefore result in the urging of the support surface 47 of guide section 19 into engagement with the casing sidewall, thereby facilitating milling procedures as previously discussed.

In one preferred embodiment, a guide section will be coupled to setting section 180 in such a manner that the nominal diameter of the guide section is not aligned with the nominal diameter of setting section 180. For example, as depicted in FIG. 11, guide section 19 has a nominal longitudinal axis 186 which is disposed at an angle relative to the nominal longitudinal axis 188 of setting section 180. The amount of angle is exaggerated in FIG. 11 for illustrative purposes. The angle between nominal longitudinal axis 186 of guide section 19 and nominal longitudinal axis 188 of setting section 180 would preferably be two degrees or less, and would preferably be one degree or less.

The described nominal longitudinal axis of guide section 119 should not be confused with the path parallel to tapered concave groove 28, but rather to the longitudinal axis of the section if the support surface were extended circumferentially to establish a cylindrical form. As an alternative, a guide section may be formed which would have either a portion disposed by diverging nominal longitudinal axis, or could be formed having an arcuate shape bending outwardly in the direction of the upper extent 50 of the guide section.

Figure 12:
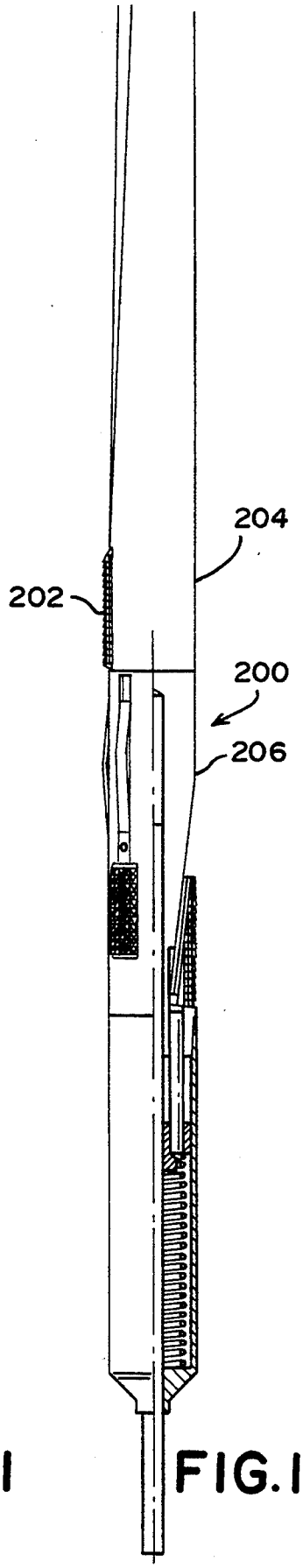
FIG. 12 schematically depicts an alternative embodiment of whipstock setting section assembly in accordance with the present invention, illustrated partially in vertical section.

Referring now to FIG. 12, therein is depicted an alternative embodiment of a whipstock assembly, indicated generally at 200, in accordance with the present invention. Whipstock assembly 200 is similar to the combination of setting section 80 of FIG. 7 with a guide member 19, with the exception that a fulcrum contact pad 202 is included on guide section 204, rather than on body section 206. The structure and operation of whipstock assembly 200, is otherwise similar to that described relative to the embodiment of FIG. 7. It will be understood by those skilled in the art, although each embodiment has been described in terms of a guide section and a body and housing section, each of the disclosed whipstocks, as well as additional variance, could be formed as a single unit.

Many modifications and variations may be made in the techniques and structures described and illustrated herein without departing from the spirit and scope of the present invention. Accordingly, the techniques and structures described and illustrated herein are illustrative only, and are not to be considered as limitations upon the scope of the present. invention.

What is claimed is:

1. A whipstock assembly, comprising:

a tapered guide surface; and a setting section operatively coupled to said taper guide surface, said setting section comprising, a housing assembly, a contact pad extending from said housing assembly, and a radially moveable member, said radially moveable member coupled to said housing on the longitudinally opposite side of said contact pad from said tapered guide surface, said radially movable member movable in a direction generally perpendicular to a pivot axis established by said contact pad.

2. The shipstock assembly of claim 1, wherein said radially moveable member comprises a casing engaging slip member.

3. The whipstock assembly of claim 2, further comprising a weight-operated mandrel for selectively moving said slip member from a first retracted position to a second, radially extended, position.

4. The whipstock assembly of claim 1, wherein said contact pad comprises at least one moveable slip member.

5. A whipstock assembly, comprising:

a guide section; and a setting section operatively coupled to said guide section assembly at a first location, said setting section comprising, a housing assembly, a contact pad assembly operatively coupled to said housing at a first location, a setting slip operatively coupled in moveable relation relative to said housing, said setting slip coupled to said housing at a second location which is longitudinally offset from said first location where said guide section assembly is coupled to said setting section, said setting slip being placed generally diametrically opposite said contact pad assembly, and a setting mandrel moveable in response to mechanical force, said setting mandrel moveable between first and second positions, wherein in said second position a force is applied to said setting slip to move said slip radially outwardly.

6. The whipstock assembly of claim 5, wherein said second location at which said setting slip is coupled to said housing is on the longitudinally opposite side of said first location where said guide section assembly is coupled to said setting section relative to said guide section.

7. The whipstock assembly of claim 5, wherein said guide section assembly comprises a partially cylindrical support surface, and a generally concave tapered guide surface, and wherein said support surface is generally longitudinally aligned with said setting slip.

8. The whipstock assembly of claim 5, wherein said contact pad assembly comprises a single contact pad operatively coupled to said housing.

9. The whipstock assembly of claim 5, wherein said contact pad assembly comprises a plurality of contact pads operatively coupled to said housing.

10. The whipstock assembly of claim 9, wherein said plurality of contact pads are arranged generally longitudinally adjacent one another on said housing, and are generally symmetrically arranged relative to a line on said housing generally diametrically opposed to the centerline of said setting slip.

11. The whipstock assembly of claim 5, wherein said contact pad assembly comprises a radially moveable member.

12. The whipstock assembly of claim 11, wherein said radially moveable member comprises a slip member.

13. A whipstock assembly, comprising:

a guide section having an upper end point; and a setting section operatively coupled to said guide section assembly at a first location, said setting section comprising, a housing assembly, an upper slip assembly operatively coupled to said housing and arranged for radial movement relative to said housing upon relative longitudinal movement between said slip and said housing, and a second slip assembly operatively coupled in moveable relation to said housing and arranged for radial movement relative to said housing upon relative longitudinal movement between said second slip and said housing, said second slip coupled to said housing at a location which will be longitudinally beneath said first location when said whipstock assembly is disposed within a wellbore.

14. The whipstock assembly of claim 13, wherein said first and second slips are each adapted to move radially outwardly upon relative downward movement of said housing relative to said slips.

15. The whipstock assembly of claim 13, wherein said second slip assembly 34 is adapted to move radially outwardly in response to relative downward movement of said housing relative to said second slip, and wherein said first slip assembly is adapted to move radially outwardly in response to relative upward movement of said housing relative to said second slip.

16. The whipstock assembly of claim 13, wherein said first and second slips are generally longitudinally aligned on one side of said housing.

17. The whipstock assembly of claim 16, further comprising a contact pad assembly disposed on said housing on a side generally opposite the side upon which said slips are coupled to said housing.

18. The whipstock of claim 13, wherein said first and second slips are located on generally diametrically opposed sides of said housing.

19. The whipstock of claim 13, wherein said setting section further comprises a contact pad extending from said housing assembly.

20. The whipstock assembly of claim 13, wherein said guide section has a nominal longitudinal axis, and wherein said setting section has a nominal longitudinal axis, and wherein the longitudinal axis of said guide section is inclined relative to said longitudinal axis of said setting section.

21. The whipstock assembly of claim 20, wherein said inclination of said nominal longitudinal axis of said guide section relative to said longitudinal axis of said setting section is less than 2 degrees.

22. The whipstock assembly of claim 21, wherein said inclination of said nominal longitudinal axis of said guide section relative to said longitudinal axis of said setting section is less than 1 degree.

* * * * *